US005246387A

United States Patent [19]

Liebich et al.

[11] Patent Number: 5,246,387

[45] Date of Patent: Sep. 21, 1993

[54] FILTER PLUG CONNECTOR

[75] Inventors: Ernst Liebich, Geltendorf; Karl Schneider, Munich, both of Fed. Rep. of Germany

[73] Assignee: Siemens Aktiengesellschaft, Munich, Fed. Rep. of Germany

[21] Appl. No.: 847,024

[22] PCT Filed: Jun. 7, 1990

[86] PCT No.: PCT/DE90/00438

§ 371 Date: Apr. 9, 1992

§ 102(e) Date: Apr. 9, 1992

[30] Foreign Application Priority Data

Oct. 12, 1989 [DE] Fed. Rep. of Germany ... 8912173[U]
May 16, 1990 [DE] Fed. Rep. of Germany ... 9005597[U]

[51] Int. Cl.[5] ..... H01R 13/66

[52] U.S. Cl. ..... 439/620; 439/95

[58] Field of Search ..... 439/95, 607, 620

[56] References Cited

U.S. PATENT DOCUMENTS 3,200,355 11/1961 Dahlen .
3,538,464 8/1963 Walsh .
4,761,147 8/1988 Gauthier ..... 439/620 X
4,784,618 11/1988 Sakamoto et al. ..... 439/620
4,791,391 12/1988 Linnell et al. .

FOREIGN PATENT DOCUMENTS 648570 5/1964 Belgium .
0123457 3/1984 European Pat. Off. .
3016315 4/1980 Fed. Rep. of Germany .

*Primary Examiner*—Eugene F. Desmond
*Attorney, Agent, or Firm*—Hill, Steadman & Simpson

[57] ABSTRACT

In the filter plug connector, connector pins (104) are conducted through a chamber of a strip body (101). A ferrite core arrangement (109) with apertures in the grid of the connector pins is pushed over the connector pins (104). In addition, a capacitive planar filter arrangement (105) is slipped over the connector pins (104) and held in the strip body by means of a shielding casing (103). The ferrite core arrangement is held in the strip body without play by spring elements of insulating material which are formed onto the base of the strip body or onto an additional holding strip. The planar filter arrangement (105) has a single soldering plane offset from the rear side of the strip body both for the connection to the connector pins and to the shielding casing.

21 Claims, 4 Drawing Sheets

FILTER PLUG CONNECTOR

BACKGROUND OF THE INVENTION

1. Field of the Invention

The invention relates to a filter plug connector having a strip body which is composed of insulating material and forms a chamber which is open at the rear side, having a number of parallel connector pins which are arranged in a grid and enter the chamber from the rear side and which emerge through the base of the chamber to the front side of the strip body, at least some of the connector pins being conducted through an aperture in a ferrite core arrangement inside the chamber and being connected to a capacitive filter element at the rear side of the chamber, and having a shielding casing covering the side walls and at least part of the rear side of the strip body and of the chamber with passage for the connector pins.

2. Description of the Related Art

In such filter plug connectors, the ferrite cores slipped onto certain connector pins serve, together with bushing-type capacitors which are arranged, for example, in the region of the shielding plate, to decouple electromagnetic interferences. In order at the same time to position and to mount the ferrite bodies, which have relatively large tolerances for production reasons, in the correct position and without play, it is known and usual to glue said ferrite bodies into the strip body of the connector. From German Published Application 3 016 315 it is furthermore known to fix filter tubes on the connector pins by filling the chamber in the strip body penetrated by the connector pins completely with curable casting compound. However, both methods give rise to laborious manufacturing steps and, in particular, the curing of the glue or of the casting compound is associated with a time loss in mass manufacture.

To mount and make contact to the capacitive filter elements, provision is made in the case of the filter plug connector according to German Published Application 3 016 315 to connect via the solder joints in at least two planes, on the one hand, the individual capacitors to the individual connector pins and, on the other hand, a common electrode of the capacitor arrangement to a conducting plate and, consequently, to the shielding casing. These various soldering operations also give rise to an expensive production of the filter plug connector.

SUMMARY OF THE INVENTION of the invention is to design a filter plug connector of the type mentioned at the outset in such a way that it can be produced with as few individual parts and with as few and as simple assembly steps as possible, it being possible, in particular, to position and fix the filter elements in the strip body in a simple manner.

According to the invention, this object is achieved in that the ferrite core arrangement is held without play in the axial direction of the connector pins by means of plastic spring elements.

As a result of the mounting, according to the invention, of the ferrite core arrangement by means of plastic spring elements, the ferrite core arrangement, whether it is now formed from single tubes or from a common block, is held and secured in the correct position. For this positioning, the individual ferrite bodies do not need either to be glued or embedded in casting compound. Said ferrite core arrangement is secured in its final position solely by being slipped onto the connector pins and by closing the chamber with the shielding plate. Expediently, at least as many individual spring elements are provided in this arrangement as individual ferrite bodies are present, so that each ferrite body is individually pressed against the base of the connector chamber or against the shielding casing.

In an advantageous embodiment, the spring elements are arranged in the base region of the chamber so that they pretension the ferrite core arrangement against the shielding casing at the rear side of the strip body. It is particularly advantageous, however, if the spring elements are formed onto the strip body as a single piece so that manufacture and assembly of an additional part are unnecessary.

The ferrite core arrangement can be formed as a common ferrite block in a single piece for at least some of the connector pins and provided with longitudinal apertures in the grid of the connector pins. In this case it is expedient for separate spring elements to be provided in the chamber for each row of connector pins. Of two rows of connector pins, it is consequently possible to provide, for example, only one, with a ferrite block of correspondingly halved size, and to hold the latter reliably in the chamber.

In particular, if tubular single ferrite bodies which are slipped onto individual connector pins are used, it is expedient that the ferrite bodies are arranged between the base of the chamber and a plastic holding strip, that the holding strip has cylindrical studs formed on in the direction of the ferrite bodies, each in the grid of the connector pins, which studs form in each case centric feedthroughs for the connector pins and have an outside diameter matched to the inside diameter of the ferrite bodies slipped onto them, and that the holding strip presses the individual ferrite bodies in each case by means of elastic sections against the base of the chamber without play.

In this case, the ferrite bodies are positioned and mounted by means of an additionally used plastic holding strip which is slipped on in a single operation and simultaneously secures all the ferrite bodies of the plug. The individual ferrite bodies do not therefore need to be either glued or embedded in casting compound. They are nevertheless held centrally on the plug pins, and this is ensured by the studs of the holding strip which engage into the individual ferrite bodies. Despite the dimensional tolerances, the ferrite bodies are also held without play, and specifically, they are pressed in each case individually against the base of the plug chamber by the elastic holding strip. To equalize the dimensional tolerances of the ferrite bodies, the holding strip can be of different designs. For example, in an expedient embodiment, provision is made that, in addition to the studs of the holding strip, a resilient tongue is formed on in each case and this pretensions a ferrite body slipped onto the stud in the direction of the base of the chamber. If such a resilient tongue is arranged in each case between two ferrite bodies, one tongue consequently rests in each case on two oppositely situated edge regions of the ferrite body, and this brings about a uniform pretensioning of said ferrite body, and tilting is therefore eliminated.

The holding strip itself can be anchored in a suitable manner in the strip body. Preferably, locking hooks are formed onto the holding strip which can be locked into oppositely situated side walls of the strip body.

In an expedient development, provision is furthermore made that a capacitive planar filter arrangement for a number of connector pins having a common substrate is arranged between the ferrite core arrangement and the rear side of the shielding casing and is soldered, on the one hand, to the individual connector pins and, on the other hand, to the shielding casing. In this connection, it is particularly advantageous if the planar filter arrangement projects partly out of the chamber beyond the rear side of the strip body in a cutout in the shielding casing and is held by angled holding lugs of the shielding casing, the solder joints between the filter arrangement and the connector pins, on the one hand, or the holding lugs, on the other hand, being situated in a common soldering plane offset from the rear side of the strip body.

The planar filter arrangement is provided with the common substrate preferably for a two-row or multi-row assembly. It is expedient, however, to provide a symmetrical structure of individual elements on the substrate in such a way that each row can be detached and used for single-row assembly. At the same time, a separating notch is provided in each case in the substrate between the rows of individual elements.

The shielding casing is expediently mounted by means of resilient side parts which engage over the side walls of the strip body and interlock with angled edge sections at its front side. Contact arms may also be cut free at these front-side edge sections and bent away resiliently from the front surface of the strip body. In this way, contact can be made to the shielding casing without additional measures using a mounting plate.

BRIEF DESCRIPTION OF THE DRAWINGS

The invention is explained in greater detail below on the basis of exemplary embodiments with reference to the drawings, In these.

DETAILED DESCRIPTION OF THE PREFERRED EMBODIMENTS

Figure 1:
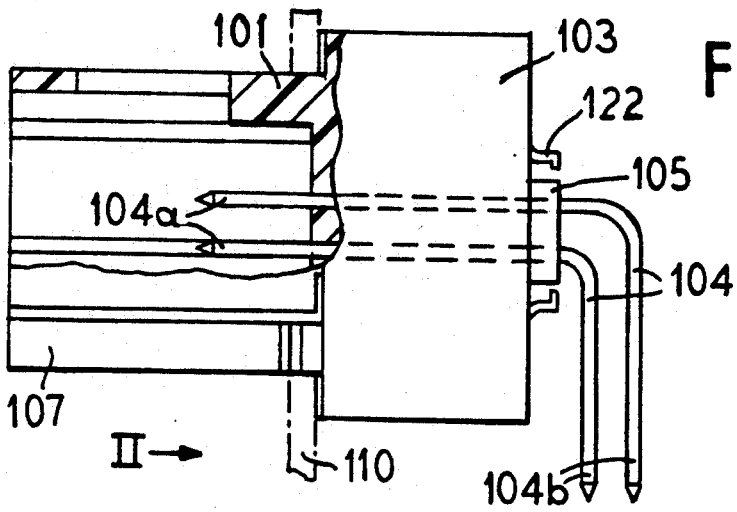
FIGS. 1 to 3 show a filter plug connector in three different views (partially cut away)
Figure 2:
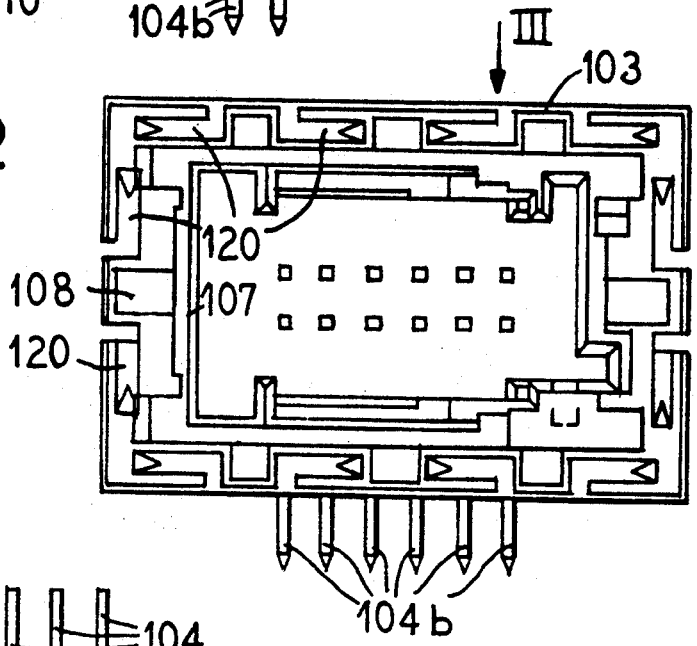
Figure 3:
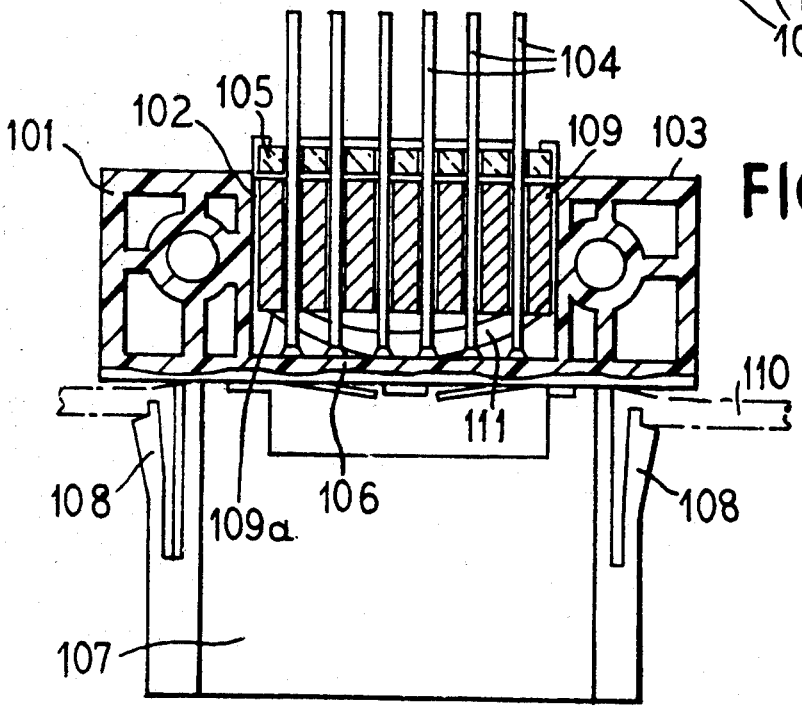
Figure 6:
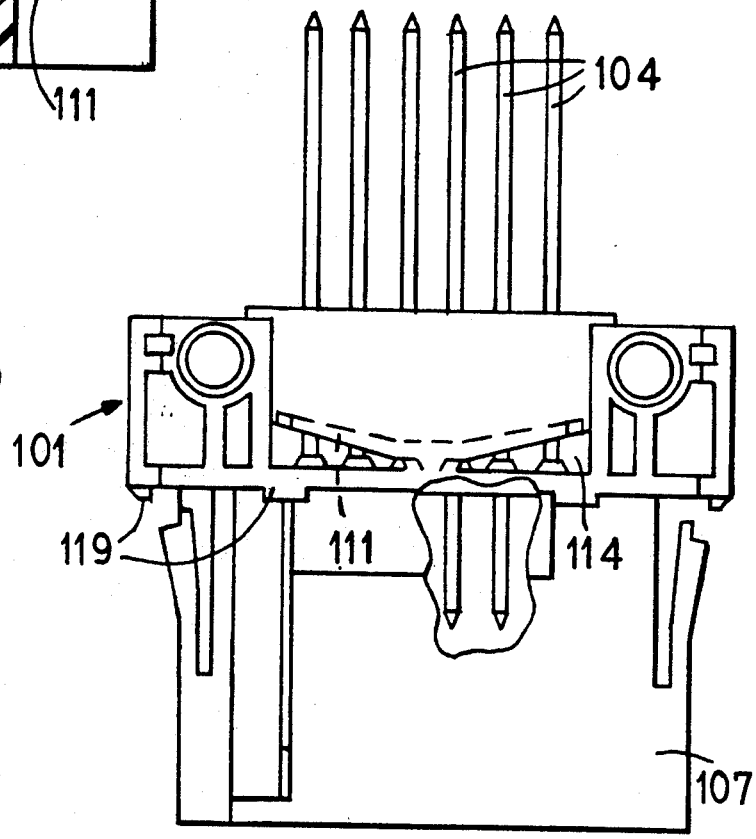
Figure 7:
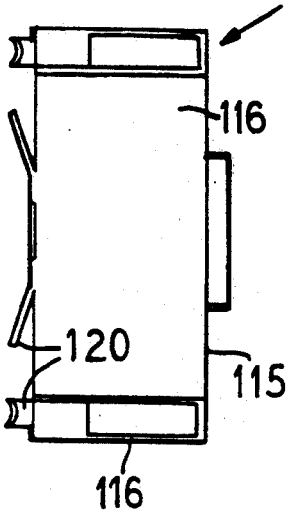
FIGS. 7 to 9 show the shielding casing in three views.
Figure 8:
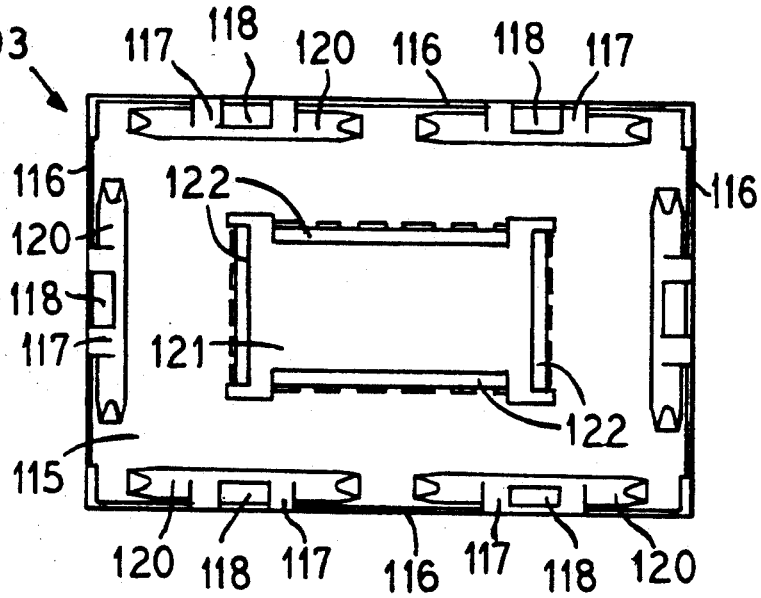
Figure 9:
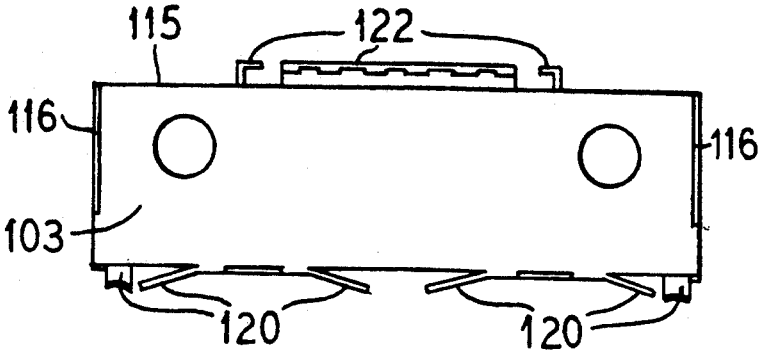

The filter plug connector illustrated in FIGS. 1 to 3 has a plastic strip body 101 (shown in detail in FIGS. 4 to 6) which forms a chamber 102 (see FIG. 3) open at the rear. The chamber 102 is closed by a shielding casing 103 (shown in detail in FIGS. 7 to 9). Conducted through the chamber 102 are connector pins 104 which enter the chamber via capacitors of a planar filter 105 (see FIG. 10) through a cutout 121 (see FIG. 8) in the shielding casing 103 and are conducted through the base 106 of the chamber to the front side of the plug connector where they form free plug ends 104*a* for connection to a socket connector. The free plug ends are surrounded by a collar 107 which is formed onto the strip body 101 and which also has locking elements 108 (see FIG. 3) for locking to a front plate 110. The connector pins 104 are arranged in a specified grid. At the rear side, the sections 104*b* of said connector pins are bent away approximately at a right angle, as shown in FIG. 1. As a result of the symmetrical structure of the plug connector, the connector pins can be bent away optionally to the right or to the left, depending on the side to which a cable, which is not shown, is to be outgoing.

Arranged in the chamber 102 (see FIG. 3) is a block-type ferrite body 109 which has apertures 109*a* in the grid of the connector pins. The ferrite body 109 is slipped onto the connector pins 104 using said apertures. For the case where only some of the connector pins, for example only one row, are to be provided with filter elements, the ferrite body can be suitably divided and then only slipped onto one row of connector pins. To hold the ferrite body 109 without play, a plurality of spring elements 111 are formed onto the strip body 101, for example by injection molding, in the base region of the chamber 102, which spring elements act symmetrically on the ferrite block 109 and prestress it in the direction of the rear side of the strip body against the shielding casing. In the embodiment shown, the spring elements 111 each extend laterally from the central region of the strip body alongside a row of connector pins and each have at their free ends an extension 112 (see FIG. 4) extending towards the connector pins. In the example shown, a total of four spring elements 111 are provided, two alongside each row of pins. If only one row of pins is to be fitted with a ferrite body, the latter is held by the two spring elements situated alongside said row of pins, whereas the other two spring elements are not used or can even be dispensed with.

Figure 5:
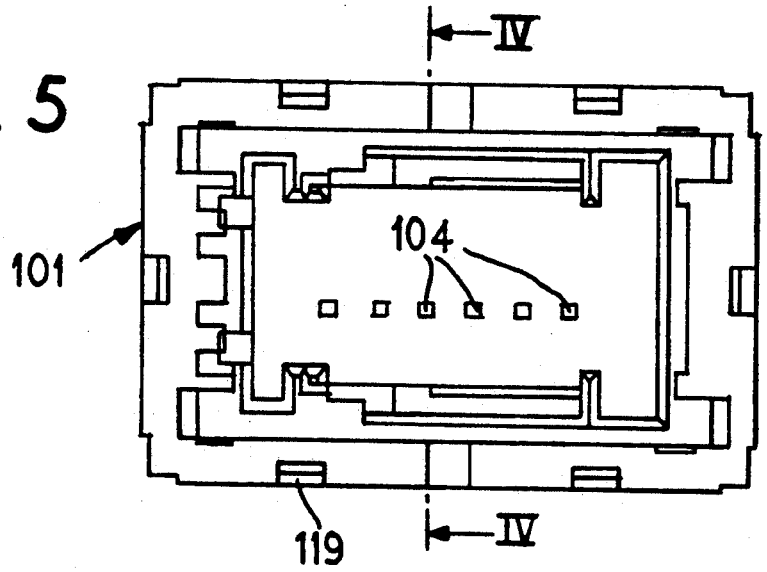
FIGS. 4 to 6 show the strip body with connector pins fitted in three views.
Figure 4:
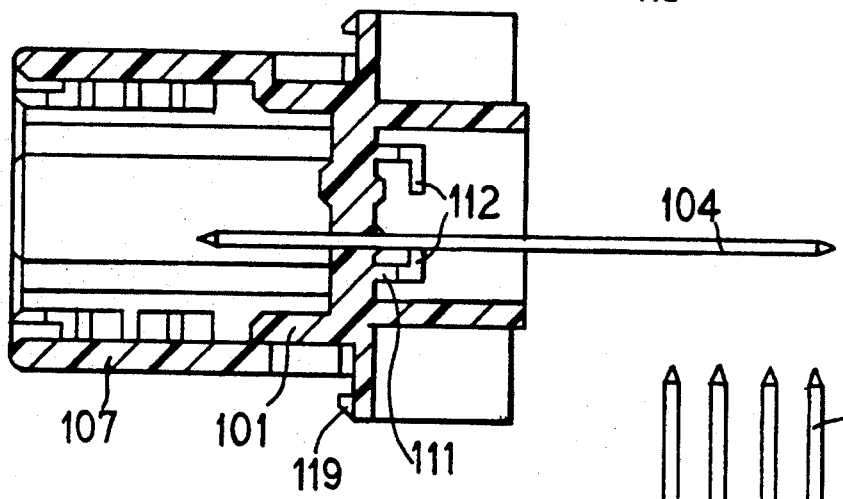

Of course, it is possible to provide only one row of pins, as is shown in FIGS. 4 and 5. If the spring elements are formed as one piece with the strip body inside the chamber, suitable slide bars which produce lateral openings 114 in the wall of the strip body (see FIG. 6) after demolding must be provided in the mold.

The shielding casing 103 is placed with a base surface 115 (see FIG. 9) over the rear side of the strip body, pushed with resiliently expanded side walls 116 in each case over the side walls of the strip body and locked at the front side of the strip body by means of angled edge sections 117. The edge sections 117 each have a cutout 118 by means of which they can be locked to corresponding bearing ribs 119 (see FIGS. 4 to 6). In addition, spring arms 120 which extend along the side walls 116 and which are bent away from the strip body and make a contact or ground connection without additional measures when the plug connector is fitted on a mounting plate 110 (see FIG. 3) are formed onto the edge sections 117. At the same time, the bearing ribs 119 prevent the spring arms 120 from being too severely deformed when the plug connector is pressed onto the mounting plate.

As a result of the inwardly bent spring arms 120 arranged in a distributed manner over the entire periphery of the shielding casing, a uniform pressure contact between the shielding casing and the mounting plate 110 is ensured. The inwardly bent springs achieve the result that all the contact forces are absorbed directly and over a large area by the strip body 101 and that a weakening of the spring force as a result of yield in plastic anchorages is avoided. In the region of the chamber 102, the base of the shielding casing has a large-area cutout 121 which is bounded at the edges by holding brackets 122 which project outwards (see FIGS. 8 and 9). These holding brackets 122 hold the planar filter element 105 and make contact to it.

Figure 10:
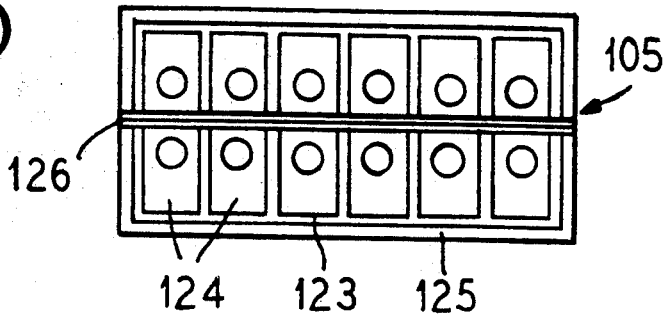
FIG. 10 shows a capacitive planar filter in plan view.

The planar filter element 105 is shown in plan view in FIG. 10. It has, on a common substrate 123, a capacitive circuit arrangement which is not shown in detail here. A contact area 124 is provided at the upper side so as to correspond to each connector pin, while a common ground contact area 125 is provided in the same plane at the upper side so as to extend around the edge. In the example shown, a separating notch 126 is preformed between the two rows of contact areas 124. The twelve-way planar filter of FIG. 10 can be divided into two six-way planar filters along said separating notch if, for example, only one row of connector pins is to be provided with a filter in the example shown.

To assemble the plug connector, the ferrite block 109 is first inserted over the connector pins 104 into the chamber 102. Then the planar filter 105 is slipped over the connector pins and subsequently pressed into the chamber and secured, the shielding casing having been placed on top, by means of the holding brackets 122 against the force of the spring elements 111. At the same time, the shielding casing 103 is locked in the manner described to the strip body 101. Contact is then made to the individual capacitor elements of the planar filter by soldering the contact areas 124 to the connector pins 104 and the contact area 125 to the holding brackets 122. As a result of the shape of the holding brackets 122, which shape is offset from the rear side of the strip body, it is possible to solder both the connector pins to the contact areas 124 and the holding brackets 122 to the contact area 125 by means of standard soldering methods, such as, for example, dip soldering or the like, in one operation. In this process, the soldering plane is offset from the rear side of the strip body so that the entire arrangement does not have to be dipped into the soldering bath up to said rear side.

Figure 12:
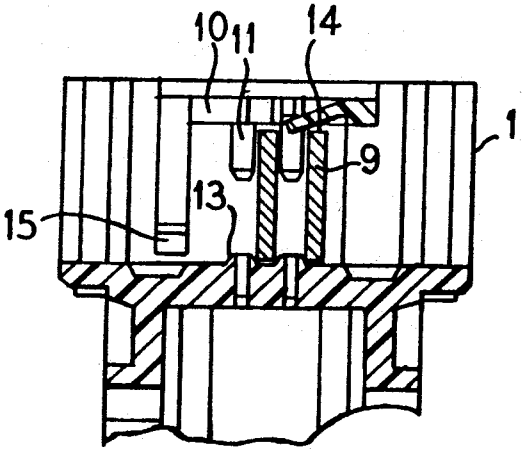
FIGS. 11 and 12 show a filter plug connector with an additional holding strip in two longitudinal sections.
Figure 11:
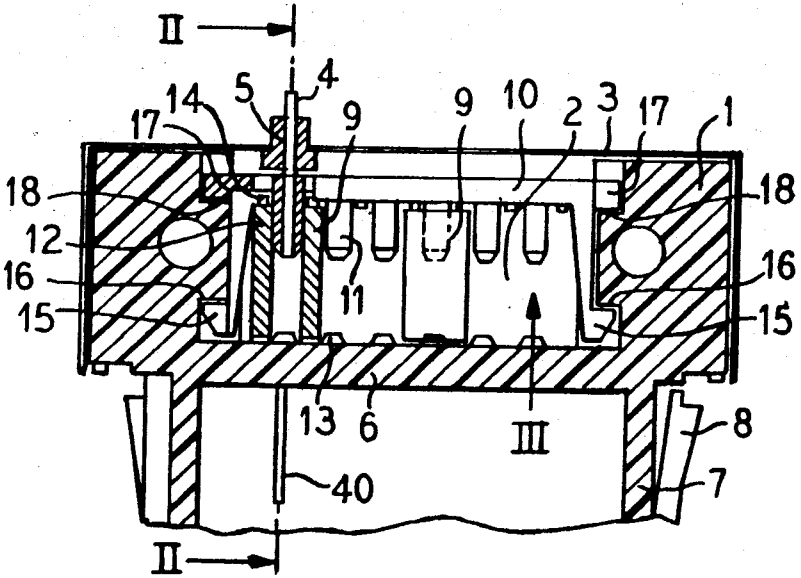

The filter plug shown in FIGS. 11 and 12 has a strip body 1 which forms a chamber 2 open to the rear. The chamber 2 is closed off by a shielding plate 3, not shown in FIG. 12. Conducted through the chamber 2 are connector pins 4 which enter the chamber via bushing-type capacitors 5 through the shielding plate 3 and are conducted through the base 6 of the chamber to the front side of the plug, where they form free plug ends 4*a* for connection to a socket connector. The free plug ends are surrounded by a collar 7 which is formed onto the strip body 1 and which also has locking elements 8 for locking a plug coupling as mating component. The connector pins 4 are arranged in a specified grid; however, only one connector pin 4 is shown in FIG. 11.

Figure 13:
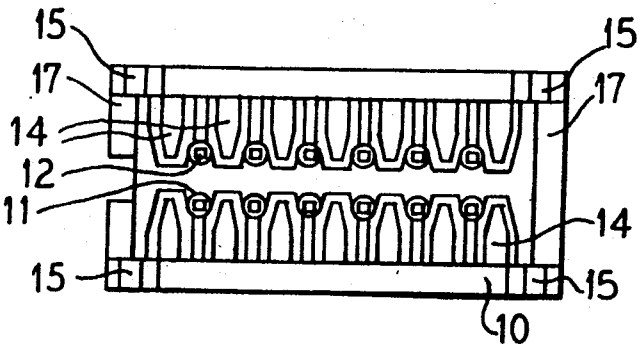
FIG. 13 shows a view from below of a holding strip according to FIGS. 11 and 12.

Tubular ferrite bodies 9 which are arranged in the chamber 2 and, together with the bushing-type capacitors 5, serve to decouple interferences are slipped onto individual connector pins. One of these ferrite bodies is shown cut away in FIGS. 11 and 12. A holding strip 10, which is composed of elastic plastic and is arranged in the chamber 2 between the ferrite bodies 9 and the shielding plate 3 parallel to the base 6, serves to fix the ferrite bodies 9 so that it presses the ferrite bodies 9 against the base 6. The holding strip, which is shown in FIG. 13 only in a view from below, has studs 11 which are in each case formed on in the grid of the connection pins and which each have an axial through cutout 12 which serves to receive the associated connector pin 4. In the present example, the feedthrough 12 is matched to the shape of the connector pins 4 by means of a square cross section. The outside diameter of the studs 11 is matched to the inside diameter of the ferrite bodies 9, so that the ferrite bodies slipped in each case onto a stud are held in a centered manner and without play against radial movements. Formed onto the base 6 of the strip body opposite the studs 11 are extensions 13 of truncated conical shape which each project more or less into the inside aperture of the ferrite bodies and thereby form a centering and also a tolerance equalization.

For fixing and for tolerance equalization in the axial direction of the ferrite bodies, the holding strip has freely resilient tongues 14 which are each formed on between the studs 11 and which rest on the edge of a slipped-on ferrite body on either side of a stud and pretension the ferrite body against the base 6. Resilient sections of the holding strip 10 of different design could, of course, also be provided instead of the tongues shown here. For example, instead of the one tongue 14 between two studs 11, two tongues could also in each case be assigned to one stud each. In the present example, however, a symmetrical clamping on both sides by the tongues 14 situated on both sides of a stud 11 also results when a ferrite body is slipped on. The reason is that in the present example, the diameter of the ferrite bodies 9 is so large that, with the existing grid of the connector pins, adjacent connector pins cannot be provided simultaneously with a ferrite body. A different embodiment would, however, also be conceivable in which, because of a greater grid spacing of the connector pins or a smaller diameter of the ferrite bodies, each adjacent connector pin could be provided with such a ferrite body. In this case, the elastic tongues or other spring sections of the holding strip would also have to be suitably designed.

The holding strip 10 is fixed by means of laterally formed-on locking hooks 15 which lock into corresponding cutouts 16 in the strip body. At the opposite end, the holding strip rests by means of its end sections 17 on corresponding shoulders 18 of the strip body. As a result of locking in the locking hooks 15, the tongues 14 are pressed against the butt ends of the ferrite bodies 9, as a result of which the latter are held without play against the base 6.

Although other modifications and changes may be suggested by those skilled in the art, it is the intention of the inventors to embody within the patent warranted heron all changes and modifications as reasonably and properly come within the scope of the their contribution to the art.

We claim:

1. A filter plug connector, comprising:

a strip body of insulating material and forming a chamber which is open at a rear side, a plurality of parallel connector pins arranged in a grid and entering said chamber from the rear side and emerging through a base of the chamber to a front side of the strip body, a ferrite core arrangement inside said chamber having apertures through which at least some of the connector pins are conducted, a capacitive filter element at the rear side of the chamber to which said at least some of the connector pins are connected, and a shielding casing covering side walls and at least part of the rear side of the strip body and of the chamber with passages for the connector pins spring means for holding the ferrite core arrangement without play in an axial direction of the connector pins by means of plastic spring elements.

2. The filter plug connector as claimed in claim 1, wherein the ferrite core arrangement is of a common ferrite block in a single piece for at least some of the connector pins and is provided with longitudinal apertures in a grid of the connector pins.

3. The filter plug connector as claimed in claim 1, further comprising:

slip-on tubular ferrite bodies are on at least some of the connector pins in a region of the chamber.

4. The filter plug connector as claimed in claim 1, wherein said spring means are in a base region of the chamber and pretension the ferrite core arrangement against the shielding casing at the rear side of the strip body.

5. The filter plug connector as claimed in claim 4, wherein said spring means are formed onto the strip body as a single piece.

6. The filter plug connector as claimed in claim 1, wherein said spring means includes separate spring elements for each row of connector pins arranged in the chamber.

7. The filter plug connector as claimed in claim 1, wherein said spring means are in each case provided in regions of said connector pins fitted with the ferrite core arrangement.

8. The filter plug connector as claimed in claim 1, wherein the ferrite core arrangement is between a base of the chamber and a plastic holding strip.

9. The filter plug connector as claimed in claim 3, including a holding strip comprising cylindrical studs extending in a direction of the ferrite bodies, each of said cylindrical studs in a grid of the connector pins, said studs form in each case centric feedthroughs for the connector pins and have an outside diameter matched to an inside diameter of the ferrite bodies and slipped onto them, and wherein the holding strip comprising elastic sections pressing individual ones of said ferrite bodies in each case by means of elastic sections against the base of the chamber without play.

10. The filter plug connector as claimed in claim 9, wherein the holding strip comprises has, in addition to the studs, in each case at least one resilient tongue which rests with pretension on an edge adjacent to it of the ferrite body slipped onto the stud.

11. The filter plug connector as claimed in claim 9, further comprising:

locking hook means fixing the holding strip to the strip body.

12. The filter plug connector as claimed in claim 9, further comprising:

extensions of truncated conical shape which each project partly into an inside aperture of the slipped-on ferrite bodies as counter-bearings formed onto the base of the chamber in the grid of the connector pins.

13. The filter plug connector as claimed in claim 9, wherein said filter element comprises:

bushing-type capacitors in the shielding casing as insulating feed-throughs for each of the connector pins, wherein the holding strip comprising an insulating wall between the ferrite bodies and the capacitors.

14. The filter plug connector as claimed in claim 1, wherein said filter element comprises:

a capacitive planar filter arrangement for a number of connector pins having a common substrate being arranged between the ferrite core arrangement and the rear side of the shielding casing and being soldered, on the one hand, to the individual connector pins and, on the other hand, to the shielding casing.

15. The filter plug connector as claimed in claim 14, wherein said shielding casing comprises a cutout and bent holding brackets, the planar filter arrangement projecting partly out of the chamber beyond the rear side of the strip body in said cutout in the shielding casing and being held by said bent holding brackets of the shielding casing, solder joints between the planar filter arrangement, on one hand, and the connector pins or the holding brackets, on the other hand, said solder joints being in a common soldering plane offset from the rear side of the strip body.

16. The filter plug connector as claimed in claim 15, wherein the planar filter arrangement is a multiple-row of individual elements in a symmetrical arrangement on the substrate in such a way that each row is selectively detachable into single-row assemblies.

17. The filter plug connector as claimed in claim 16, wherein the substrate of the planar filter arrangement has in each case a separating notch between the rows of individual elements.

18. The filter plug connector as claimed in claim 1, further comprising:

resilient side parts and interlocks with angled edge sections at a front side of said shielding casing in engagement over side walls of said strip body.

19. The filter plug connector as claimed in claim 18, further comprising:

contact arms cut free at the front-side edge sections of the shielding casing and projecting resiliently from the front side of the strip body.

20. The filter plug connector as claimed in claim 19, further comprising:

bearing ribs limiting travel of the contact tongues between the resilient contact arms at the front side of the strip body.

21. The filter plug connector as claimed in claim 20, wherein edge sections of the shielding casing define cutouts that are locked to the bearing ribs.

* * * * *